United States Patent [19]

Ahmed

[11] 4,059,793

[45] Nov. 22, 1977

[54] SEMICONDUCTOR CIRCUITS FOR GENERATING REFERENCE POTENTIALS WITH PREDICTABLE TEMPERATURE COEFFICIENTS

[75] Inventor: Adel Abdel Aziz Ahmed, Annandale, N.J.

[73] Assignee: RCA Corporation, New York, N.Y.

[21] Appl. No.: 714,361

[22] Filed: Aug. 16, 1976

[51] Int. Cl.[2] ..... G05F 1/58

[52] U.S. Cl. ..... 323/19; 307/297; 323/22 T; 323/23

[58] Field of Search ..... 323/1, 4, 9, 19, 227, 323/68; 307/296, 297; 330/32

[56] References Cited

U.S. PATENT DOCUMENTS

| | | | |
|---|---|---|---|
| 3,579,133 | 5/1971 | Harford | 330/32 |
| 3,617,859 | 11/1971 | Dobkin et al. | 323/4 |
| 3,659,121 | 4/1972 | Frederiksen | 307/297 |
| 3,781,648 | 12/1973 | Owens | 323/4 |
| 3,794,861 | 2/1974 | Bernacchi | 307/297 |
| 3,887,863 | 6/1975 | Brokaw | 323/22 T |

OTHER PUBLICATIONS

"Stable Voltage Ref. Crt." by J. E. Gersbach, IBM Tech. Disc. Bull., vol. 18, No. 7, Dec. 1975, pp. 2091–2092.

*Primary Examiner*—Gerald Goldberg

*Attorney, Agent, or Firm*—H. Christoffersen; S. Cohen; A. L. Limberg

[57] ABSTRACT

A positive-temperature-coefficient difference between the emitter-to-base potentials of two transistors in particular configuration is scaled up and added to one of the emitter-to-base potentials to develop a potential, a multiple of which is supplied as the reference potential.

7 Claims, 7 Drawing Figures

Figure 1:
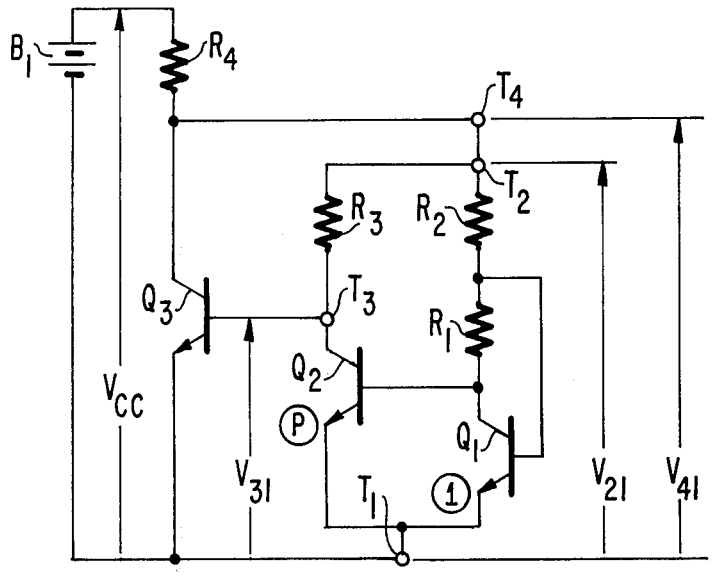

SEMICONDUCTOR CIRCUITS FOR GENERATING REFERENCE POTENTIALS WITH PREDICTABLE TEMPERATURE COEFFICIENTS

Circuits are known for generating reference potentials related to $V_{g(0)}$, the band-gap potential of a semiconductor material such as silicon, extrapolated to zero Kelvin. They may be particularly suited to fabrication in integrated circuit form. See R. J. Widlar's article, "New Developments in IC Voltage Regulators" appearing on pp. 2–7 of *IEEE Journal of Solid State Circuits,* Vol. SC-6, No. 1, February 1971, and K. E. Kuijk's article "A Precision Reference Voltage Source" appearing on pp. 222–226 of IEEE Journal of Solid State Circuits, Vol. SC-8, No. 3, June 1973. See, too, U.S. Pat. Nos. 3,271,660 (Hilbiber), 3,617,859 (Dobkin etal.), 3,648,153 (Graf) and 3,887,863 (Brokaw).

The present invention is embodied in a reference potential generator with superior potential regulation properties. While not restricted thereto, a number of embodiments of the invention are suitable for generating potentials related to $V_{g(0)}$.

Figure 2:
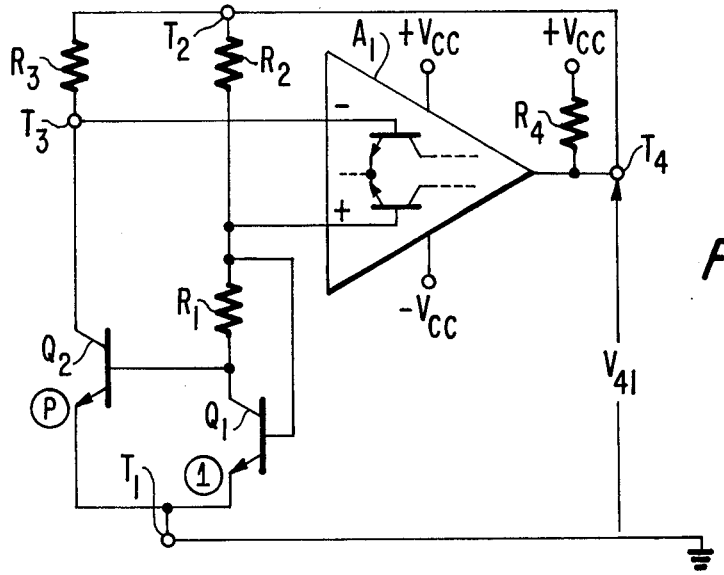
Figure 3:
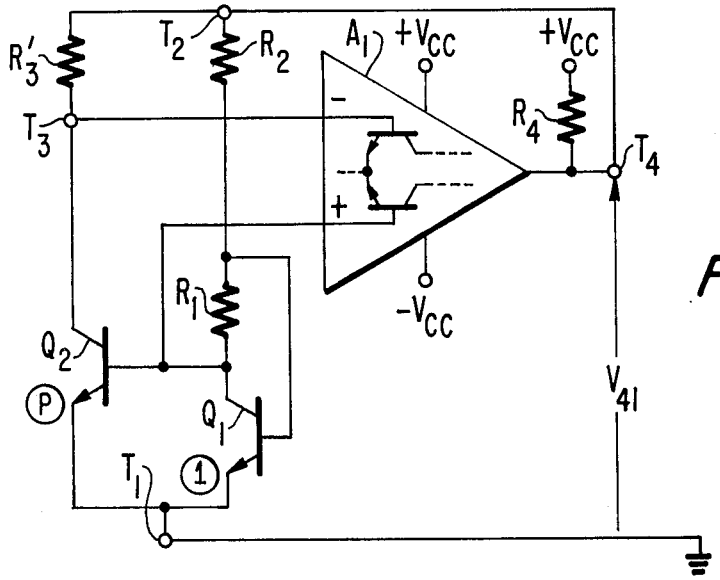
Figure 4:
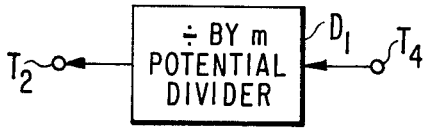
Figure 5:
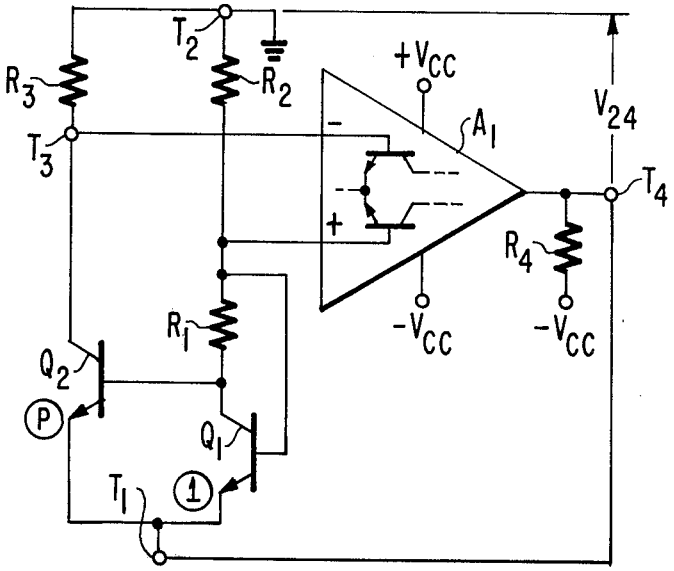
Figure 6:
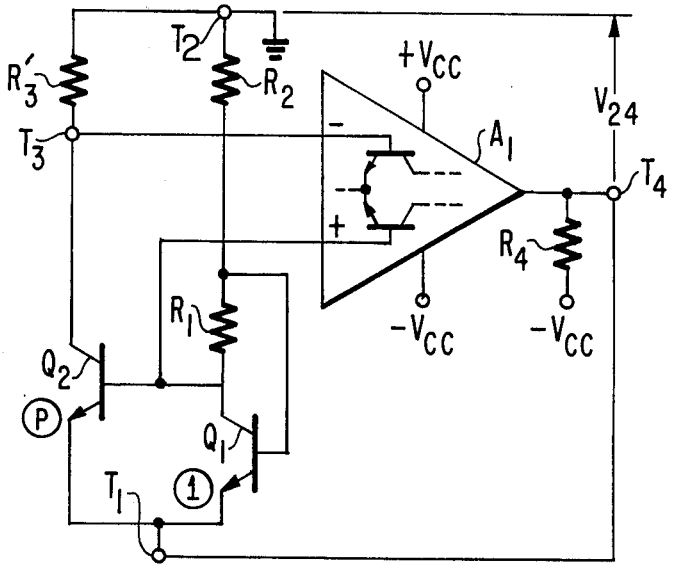
Figure 7:
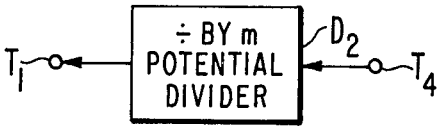

In the drawing:

each of FIGS. 1, 2, 3, 5 and 6 is a schematic diagram of a reference potential generator furnishing a reference potential substantially equal to the $V_{g(0)}$ of the semiconductive material from which its transistors are fabricated;

FIG. 4 is a block schematic diagram showing how the circuits of FIGS. 1, 2 and 3 may be modified to increase the reference potential by a factor *m;* and FIG. 7 is a block schematic diagram showing how the circuits of FIGS. 5 and 6 may be modified to increase the reference potential by a factor *m.*

Each of the FIGS. 1, 2, 3, 5 and 6 includes first and second transistors $Q_1$ and $Q_2$, respectively, and first, second and third resistive elements $R_1$, $R_2$ and $R_3$, respectively. Each also includes first, second and third terminals $T_1$, $T_2$ and $T_3$, respectively. $Q_1$ and $Q_2$ are operated at the same absolute temperature T expressed in units Kelvin. $Q_1$ and $Q_2$ have respective base-emitter junctions with similar profiles and respective effective areas in *l:p* ratio, *p* being a positive number, as indicated by the encircled numbers near their respective emitter electrodes.

In FIG. 1, a bias means comprising the series connection of battery $B_1$ supplying potential $V_{CC}$ and resistor $R_4$ tends to keep terminal $T_4$ (and terminal $T_2$ connected thereto) at a different potential from terminal $T_1$. A degenerative feedback connection is provided wherein $V_{21}$, the difference in potential between $T_1$ and $T_2$, is coupled via $R_3$ to terminal $T_3$ at the base electrode of transistor $Q_3$. The feedback biases $Q_3$, which has its emitter electrode connected to $T_1$, into conduction. The resultant collector-to-emitter current demand presented by $Q_3$ is met from battery $B_1$, with the collector current $I_{CQ3}$ of $Q_3$ causing a potential drop across $R_4$ that reduces the potential $V_{41}$ between $T_1$ and $T_4$ to carry out shunt potential regulation of $V_{21}$. This degenerative feedback connection would—were the connection comprising $Q_1$, $Q_2$, $R_1$ and $R_2$ not present—operate to reduce $V_{21}$ to a value equal to the emitter-to-base potential $V_{BEQ3}$ of $Q_3$ required to support a collector current flow substantially equal to $(V_{CC} - V_{BEQ3})/R_4$—e.g., somewhere from 500 to 700 millivolts.

The connection comprising elements $Q_1$, $Q_2$, $R_1$ and $R_2$ provides for a regenerative feedback connection in addition to the degenerative feedback connection described. At low values of $V_{21}$, the regenerative feedback connection has sufficient gain to overwhelm the effects of the degenerative feedback connection. But as $V_{21}$ is increased, the gain of the regenerative feedback connection is reduced, and at some predictable value of $V_{21}$, the degenerative and regenerative feedback connections are so proportioned that the Nyquist criterion for stable equilibrium is met.

At low values of $V_{21}$, very little current will flow through the series combination of $R_2$ and $Q_1$ (regarded as a self-biased transistor). The portion of this current flowing through $R_1$ will cause a negligibly small potential drop across $R_1$, so the emitter-to-base potentials of $Q_1$ and $Q_2$ will be substantially equal. Current mirror amplifier action will thus obtain between transistors $Q_1$ and $Q_2$. The collector current $I_{CQ2}$ of $Q_2$ will accordingly be about *p* times as large as the collector current $I_{CQ1}$ of $Q_1$, the major component of the current flowing through the series combination of $R_2$ and $Q_1$ (regarded as a self-biased transistor). Any increase of $V_{21}$ above $V_{BEQ1}$ will cause a current $(V_{21} - V_{BEQ1})/R_2$ to flow through $R_2$, the major portion of which current will flow as $I_{CQ1}$. $I_{CQ2}$ will be about *p* times as large as $I_{CQ1}$ —i.e., $p\ (V_{21} - V_{BEQ1})/R_2$— causing a potential drop $V_{32}$ across $R_3$ substantially equal to $p(V_{21} - V_{BEQ1})R_3/R_2$. So, if $pR_3/R_2$ be substantially larger than unity, increasing $V_{21}$ will decrease rather than increase the potential $V_{31}$ appearing between terminals $T_1$ and $T_3$ and applied as base-emitter potential to $Q_3$. Conduction of $Q_3$ will be suppressed, permitting $V_{21}$ to grow towards its upper limit value of $V_{CC}$.

At higher values of $V_{21}$, the current $(V_{21} - V_{BEQ1})/R_2$ through $R_2$ increases. The major portion of this current flows as $I_{CQ1}$ through $R_1$ to cause a potential drop across $R_1$. For each 18 millivolts of drop across $R_1$, $I_{CQ2}$ is reduced by an additional factor of two compared to $I_{CQ1}$. So, while $I_{CQ2}$ as well as $I_{CQ1}$ increases with increasing $V_{21}$, its increase is slower than that of $I_{CQ1}$. $I_{CQ1}$ increases almost linearly with increasing $V_{21}$, and it will be shown that $I_{CQ2}$ increases substantially less than linearly with increasing $V_{21}$. The current flowing from $T_2$ to $T_3$ via $R_3$ has a value $(V_{21} - V_{BEQ3})/R_3$ and so increases substantially linearly with increasing $V_{21}$, at some value of $V_{21}$ overtaking $I_{CQ2}$ in amplitude sufficiently to provide substantial base current to $Q_3$. This base current renders $Q_3$ conductive to carry out shunt regulation of $V_{21}$ against further increase.

Consider now why $I_{CQ2}$ increases substantially less than linearly with increasing $V_{21}$. The operation of transistors $Q_1$ and $Q_2$ can be expressed in terms of the following expressions, as is well-known.

$$V_{BEQ1} = (kT/q)ln(I_{CQ1}/A_{Q1}J_S) \quad (1)$$

$$V_{BEQ2} = (kT/q)ln(I_{CQ2}/A_{Q2}J_S) \quad (2)$$

where $V_{BEQ1}$ and $V_{BEQ2}$ are the respective base-emitter junction potentials of $Q_1$ and of $Q_2$, $k$ is Boltzmann's constant, T is the absolute temperature at which $Q_1$ and $Q_2$ are both operated, $q$ is the charge on an electron, $I_{CQ1}$ and $I_{CQ2}$ are the respective collector currents of $Q_1$ and of $Q_2$, $A_{Q1}$ and $A_{Q2}$ are the respective effective areas of the base-emitter junctions of $Q_1$ and $Q_2$, and $J_S$ is a saturation current density term presumed to be common to $Q_1$ and $Q_2$. At lower levels of input current applied to terminal $T_4$, the collector current of $Q_1$ is commensurately low, so that the base potential of $Q_1$ is applied to the base electrode of $Q_2$, without substantial drop across resistance $R_1$ due to $I_{CQ1}$. Eliminating $V_{BE}$ between equations 1 and 2, $I_{CQ2}/I_{CQ1}$ at very low levels of collector current can be shown to be as follows:

$$(I_{CQ2}/I_{CQ1}) = A_{Q2}/A_{Q1} = p \quad (3)$$

With increasing level of the input current, which $I_{CQ1}$ is adjusted to equal, the drop $V_1$ across resistor $R_1$, essentially equal to $I_{CQ1}R_1$, is increased.

$$V_1 = V_{BEQ1} - V_{BEQ2} \quad (4)$$

Substituting equations 1, 2 and 3, into equation 4, yields the following expression.

$$(I_{CQ2}/I_{CQ1}) = p \exp^{-1}(qV_1/kT) \quad (5)$$

The potential drop $V_2$ across $R_2$ is caused primarily by the flow of $I_{CQ1}$ and is equal to the difference between $V_{21}$ and $V_{BEQ1}$.

$$V_2 = I_{CQ1}R_2 \quad (6)$$

$$V_2 = V_{21} - V_{BEQ3} \quad (7)$$

An expression for $I_{CQ1}$ can be obtained by cross-solving equations 6 and 7.

$$I_{CQ1} = (V_{21} - V_{BEQ3})/R_2 \quad (8)$$

$V_1$ is caused primarily by the flow of $I_{CQ1}$.

$$V_1 = I_{CQ1}R_1 \quad (9)$$

Substituting equations 8 and 9 into equation 5, one obtains equation 10 describing $I_{CQ2}$ in terms of $V_{21}$.

$$I_{CQ2} = p(V_{21} - V_{BEQ3})/R_2 \exp(R_1/R_2)(V_{21} - V_{BEQ3})(q/kT) \quad (10)$$

The improved regulation characteristics of the reference potential generators built in accordance with the present invention are due to the very great percentage change in the current gain of the configuration comprising elements $Q_1$, $Q_2$, $R_1$ and $R_2$ and linking $T_2$ to $T_3$ to apply non-linear regenerative collector-to-base feedback to $Q_3$, responsive to small percentage changes in $V_{21}$. This percentage change in current gain with small percentage change in $V_{21}$ is substantially superior to the non-linear regenerative feedback configuration as used by Widlar and Brokaw, differing from that shown by $R_1$ being replaced by direct connection and by the emitter of $Q_2$ being provided an emitter degeneration resistance. The current amplifier comprising elements $Q_1$, $Q_2$, $R_1$ and $R_2$ is per se known from U.S. Pat. Nos. 3,579,133 (Harford) and 3,659,121 (Frederiksen), but its non-linear current gain properties are not made use of as in the present invention.

Consider now how $V_{21}$ may be regulated to be substantially equal to $V_{g(0)}$ the bandgap potential, as extrapolated to zero Kelvin, of the semiconductor material from which $Q_1$, $Q_2$ and $Q_3$ are made. $V_{g(0)}$ exhibits zero temperature coefficient and, assuming the transistors to be silicon transistors, has a value of about 1.2 volts. One can discern that the FIG. 1 reference potential generator is capable of synthesizing $V_{g(0)}$ since $V_{21}$ is equal to the sum of the base-emitter offset potential of a transistor ($Q_1$) and a potential proportional to the difference in the base-emitter potentials of two transistors (the drop across $R_2$), such a summation being a known technique for synthesizing $V_{g(0)}$. The potential drop across $R_2$ is proportional to the drop across $R_1$ since: $R_1$ and $R_2$ conduct substantially the same current, and the drop across $R_1$ is known to equal $V_{BEQ1} - V_{BEQ2}$.

Knowing $V_{CC}$ and what $V_{41}$ is to be in terms of $V_{g(0)}$, one can select a value of $R_4$ in accordance with Ohm's Law to provide a convenient nominal value of operating current, respective portions of which flow to $Q_3$ as collector current $I_{CQ3}$, through $R_3$, and through the series combination of $R_2$ and self-biased $Q_1$. $V_{21}$ will have a value substantially equal to 1236mV and $V_{BEQ1}$ is about 550 - 700mV depending on $I_{CQ1}$. So the potential drop $V_2$ across $R_2$ is about 540 - 690mV. $R_2$ can be calculated by Ohm's Law, dividing the 540 - 690mV drop by $I_{CQ1}$. The potential drop $V_1$ across $R_1$ is typically chosen to be 60mV or so at equilibrium, so the scaling factor between $R_1$ and $R_2$ is not too large, this drop divided by $I_{CQ1}$ yields a value of $R_1$ about one-tenth or so of $R_2$. Knowing the equilibrium value of the voltage drop across $R_1$, one knows the value of $I_{CQ2}/I_{CQ1}$ in terms of $p$, from equation 5. If $V_1$ is 60mV, and $p$ unity, $I_{CQ2}$ will be one-tenth $I_{CQ1}$. Assuming the potential drop across $R_3$ to be substantially all attributable to $I_{CQ2}$ and to be substantially equal to $V_2$, one can calculate $R_3$ by Ohm's Law to be $V_2/I_{CQ2}$, which equals $(V_2/I_{CQ1})(I_{CQ1}/I_{CQ2})$, which equals $R_2(I_{CQ1}/I_{CQ2})$ or about 10 $R_2$. Such calculations yield values of $R_1$, $R_2$ and $R_3$ of 600, 5600 and 56000 ohms, respectively, for example, with $R_4$ chosen to supply an $I_{CQ1}$ of 0.1mA, an $I_{CQ2}$ of 0.01mA, and an $I_{CQ3}$ of 0.1mA—i.e., a total of some 0.2mA.

The FIG. 1 reference potential generator has the shortcoming, acceptable in some applications but not in others, that it depends upon $V_{BEQ3}$ being determinate to obtain good regulation of $V_{21}$. $V_{BEQ3}$ changes by 18 millivolts for each doubling of its collector current, however, so if the current applied between $T_1$ and $T_2$ of the reference voltage generator changes, the regulation of $V_{21}$ will be affected. An improvement would be to provide a threshold voltage for sensing the potential between $T_1$ and the second end of $R_3$ that would be substantially less dependent upon the operating current supplied to the reference potential. It would also be desirable, if possible, to reduce the current loading upon $T_3$ posed by the shunt regulating device while at the same time increasing the transconductance of the shunt regulating device.

The present inventor observed that the regulated value of $V_{21}$ applied to the series combination of $R_2$ and self-biased $Q_1$ causes the collector current $I_{CQ1}$ of transistor $Q_1$ to be quite well-regulated so the value of $V_{BEQ2}$ is substantially independent of the operating current supplied to the reference potential generator of FIG. 1. FIG. 2 shows a reference potential generator taking advantage of this observation to provide improvements upon the FIG. 1 reference potential generator.

In FIG. 2, a differential input amplifier $A_1$, such as an operational amplifier, replaces $Q_3$ in combination with $R_4$ to provide the means for sensing when the potential between $T_1$ and $T_3$ exceeds a predetermined threshold value to generate a reference potential directly related to such excess. The threshold value is set by $V_{BEQ1}$, which because of $V_{21}$ being regulated is of more determinate value than $V_{BEQ3}$. Rather than measuring the potential between $T_1$ and $T_3$ directly, one does it indirectly by comparing the potentials between the base of $Q_1$ and $T_3$. This permits substantially greater freedom of design of the amplifier $T_3$ works into. $A_1$ may use Darlington transistors of FET's in its input stage to reduce loading on the base of $Q_1$ and on $T_3$, and one may readily use cascaded amplifier stages to secure very high transconductance in $A_1$ to improve the regulation of $V_{41}$.

FIG. 3 shows a reference potential generator that may be used instead of the FIG. 2 reference potential generator, in which $V_{BEQ2}$ rather than $V_{BEQ1}$ is used as the threshold value against which the potential at $T_3$ is compared. $R_3'$ is equal to $R_3(R_1 + R_2)/R_1$. Other modifications are possible in which the threshold value is between $V_{BEQ1}$ and $V_{BEQ2}$, being obtained from a point along $R_1$. Modifications of the FIG. 2 reference potential generator in which the inputs of $A_1$ are taken from taps on resistors $R_2$ and $R_3$ are also possible.

FIG. 4 shows a modification that can be made to any of the reference potential generators shown in FIGS. 1 through 3, which modification will increase the reference potential $V_{41}$ it produces by a factor *m*. This modification consists of a potential divider $D_1$ having an input terminal connected to $T_4$ and an output terminal connected to $T_2$. Potential divider $D_1$ divides the potential $V_{41}$ by a factor *m* to obtain the potential $V_{21}$ for application between $T_1$ and $T_2$.

FIGS. 5 and 6 show modifications of the reference potential generators of FIGS. 2 and 3, respectively, useful for providing $V_{24}$ reference potentials relatively negative, rather than relatively positive, as referred to a fixed potential shown as ground.

FIG. 7 shows a modification that can be made to either of the reference potential generators shown in FIGS. 5 and 6, which modification will increase the reference potential $V_{24}$ it produces by a factor *m*. This modification consists of a potential divider $D_2$ having an input terminal connected to $T_4$ and an output terminal connected to $T_1$. Potential divider $D_2$ divides the potential $V_{24}$ by a factor *m* to obtain the potential $V_{21}$ for application between $T_1$ and $T_2$.

In the circuits of FIGS. 2, 3, 5 and 6 as shown or as modified by FIGS. 4 and 7, $R_4$ may be omitted if $A_1$ is a conventional operational amplifier rather than an operational transconductance amplifier.

In the reference potential generators of the sort shown in FIGS. 2, 3, 5 and 6, the value of $V_{21}$ that exhibits a zero temperature coefficient will depart somewhat from $V_{g(0)}$ depending upon the temperature coefficient of the resistors $R_1$, $R_2$ and $R_3$. The $(V_{21} - V_{BEQ1})$ drop across $R_2$ of about 600mv will increase 1.75mV per Kelvin increase in temperature due to the negative temperature coefficient of $V_{BEQ1}$. So $I_{CQ1}$, the major portion of the current through $R_2$, will be held substantially constant if $R_2$ has a positive temperature coefficient as expressed in percentage equal to that of the potential drop across it $+1.75\text{mV}/k/600\text{mv} = +0.29\%/K$. Such temperature coefficients can be achieved with ion-implanted integrated resistors. But diffused resistors normally have lower positive temperature coefficients—e.g., $+0.2\%/K$—causing the zero-temperature-coefficient value of $V_{21}$ to vw less than $V_{g(0)}$ by thirty-five millivolts or so.

While the provision of a zero-temperature-coefficient reference potential $V_{41}$ (or $V_{24}$) equal to $V_{g(0)}$ has been specifically treated in the foregoing specification, the reference potential generator configurations shown are useful for generating reference potentials having other temperature coefficients. These $V_{41}$'s (or $V_{24}$'s) may be negative-temperature-coefficient potentials that are a multiple of $V_{21}$'s that range between $V_{BEQ1}$ to $V_{g(0)}$. Or these $V_{41}$'s (or $V_{24}$'s) may be positive-temperature-coefficient potentials that are multiples of $V_{21}$'s larger than $V_{g(0)}$.

What is claimed is:

1. A reference potential generator comprising:
first and second and third terminals;
bias means for tending to increase the potential between said first and said second terminals;
first and second transistors of the same conductivity type, each having base and emitter electrodes with a base-emitter junction therebetween and having a collector electrode, each of their emitter electrodes being directly connected without substantial intervening impedance to said first terminal;
a first resistive element having a first end which connects to the base electrode of said first transistor and having a second end which connects to the base electrode of said second transistor and has the collector electrode of said first transistor connected thereto;
a second resistive element having a first end connected to said second terminal and having a second end connected to the first end of said first resistive element;
a third resistive element having a first end connected to said second terminal and having a second end connected to a third terminal and to the collector electrode of said second transistor;
means for sensing when the potential between said first and third terminals exceeds a predetermined threshold value to decrease the potential between said first and said second terminals, thereby to generate a reference potential; and
means applying between said first and said second terminals a fixed portion of said reference potential, thereby completing a feedback loop for regulating said reference potential to prescribed value.

2. A reference potential generator as set forth in claim 1 wherein said means for sensing when the potential between said first and said third terminals exceeds a predetermined threshold potential to generate a reference potential directly related to said excess senses the potential between said first and said third terminals directly and comprises:
a third transistor of said same conductivity type having emitter and base electrodes respectively connected to said first terminal and to said third terminal, having a base emitter junction between its emitter and base electrodes, the offset potential of which corresponds to said predetermined threshold value, and having a collector electrode direct coupled to said second terminal.

3. A reference potential generator as set forth in claim 1 wherein said means for sensing when the potential between said first and said third terminals exceeds a predetermined threshold potential to generate a reference potential directly related to said excess senses the potential between said first and said third terminals indirectly and comprises:
a differential-input amplifier having an inverting input terminal connected to said third terminal, having a non-inverting input terminal to which a predetermined threshold potential related to at least one of the base potentials of said first and said second transistors is applied, and having output terminals between which said reference potential is supplied.

4. A solid-state temperature-compensated voltage supply comprising:

first and second transistors;

a resistor connected between the base of said first transistor and the base of said second transistor;

circuit mears for furnishing supply voltage to said two transistors to develop current flow therethrough with a current through said first transistor also flowing through said resistor;

means for sensing the magnitude of the respective currents flowing through said two transistors;

voltage-control means responsive to the currents sensed by said sensing means and operable to adjust the emitter potentials of said transistors to maintain the magnitude of said transistor currents at levels which provide a predetermined non-unity ratio of current densities within the two transistors responsive to which they exhibit a difference in their emitter-to-base offset potentials that is applied to said resistor connected between their bases to cause the current through said resistor to vary positively with respect to the temperature of said two transistors;

means for developing a first voltage proportional to said resistor current and for combining said first voltage with a second voltage which varies negatively with respect to said temperature to produce a combined voltage having minimal overall variation with respect to said temperature; and output means coupled to said last named means and including an output terminal providing an output voltage proportional to said combined voltage.

5. A voltage supply as claimed in claim 4, wherein said voltage-control means comprises:

a high-gain amplifier serving as a comparator responsive to signals proportional to said current flows through said first and said second transistors to produce an output signal corresponding to the difference between said signals proportional to said current flows; and means coupling a voltage proportional to said output signal to the emitters of said transistors to drive the emitter potentials to values providing the desired ratio of current density in said transistors.

6. A voltage supply as claimed in claim 5 wherein said sensing means comprises first and second load resistors connected in the collector circuits of said first and said second transistors, respectively.

7. A voltage supply as claimed in claim 4 wherein the emitters of said first and said second transistors are connected together to provide equal emitter potentials.

* * * * *